US006429184B1

(12) United States Patent
Akkermans et al.

(10) Patent No.: US 6,429,184 B1
(45) **Date of Patent: *Aug. 6, 2002**

(54) PRODUCTION OF DETERGENT GRANULATES

(75) Inventors: Johannes Hendrikus Akkermans, Vlaardingen (NL); Michael Frederick Edwards, Bebington (GB); Andreas Theodorus Groot, Vlaardingen (NL); Cornelis Paulus Montanus, Vlaardingen (NL); Roland Wilhelmus Pomeren, Vlaardingen (NL); Korkut Ahmet Yuregir, Bebington (GB)

(73) Assignee: Lever & Brothers Company, division of Conopco, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/659,715

(22) Filed: Sep. 11, 2000

Related U.S. Application Data

(63) Continuation of application No. 09/097,335, filed on Jun. 15, 1998, now Pat. No. 6,274,544.

(30) Foreign Application Priority Data

Jun. 16, 1997 (GB) ..... 9712583

(51) Int. Cl.[7] ..... C11D 11/00

(52) U.S. Cl. ..... 510/444; 510/495; 264/117; 23/313 FB

(58) Field of Search ..... 510/444, 495; 264/117; 23/313 FB

(56) References Cited

U.S. PATENT DOCUMENTS

| | | | | |
|---|---|---|---|---|
| 3,650,961 A | | 3/1972 | Hudson | 510/530 |
| 4,153,625 A | | 5/1979 | Barton et al. | 260/457 |
| 4,183,763 A | | 1/1980 | Omilinsky et al. | 106/109 |
| 4,219,589 A | | 8/1980 | Niks et al. | 427/213 |
| 4,364,750 A | | 12/1982 | Koncz | 55/89 |
| 4,421,669 A | * | 12/1983 | Brichard | 252/186.25 |
| 4,473,485 A | | 9/1984 | Greene | 510/361 |
| 4,487,710 A | | 12/1984 | Kaminsky | 510/362 |
| 4,530,774 A | * | 7/1985 | Davies et al. | 510/348 |
| 4,539,135 A | | 9/1985 | Ramachandran et al. | 510/349 |
| 4,619,843 A | | 10/1986 | Musters | 427/213 |
| 4,664,950 A | | 5/1987 | Wixon | 427/214 |
| 4,666,740 A | * | 5/1987 | Wixon | 510/356 |
| 4,701,353 A | | 10/1987 | Mutsers et al. | 427/213 |
| 4,734,224 A | | 3/1988 | Barrett et al. | 252/558 |
| 4,828,721 A | | 5/1989 | Bollier et al. | 510/444 |
| 4,857,223 A | * | 8/1989 | Borrello | 510/293 |
| 4,881,940 A | * | 11/1989 | Massaux et al. | 8/111 |
| 5,290,603 A | | 3/1994 | Nielsen et al. | 427/421 |
| 5,516,447 A | | 5/1996 | Bauer et al. | 252/89.1 |
| 5,629,275 A | | 5/1997 | Bauer et al. | 510/108 |
| 5,739,097 A | | 4/1998 | Bauer et al. | 510/446 |
| 5,929,021 A | | 7/1999 | Dhanuka et al. | 510/444 |
| 6,056,905 A | * | 5/2000 | Akkermans et al. | 264/117 |

FOREIGN PATENT DOCUMENTS

| | | |
|---|---|---|
| DE | 140 987 | 4/1980 |
| DE | 255 833 | 4/1988 |
| DE | 42 32 874 | 3/1994 |
| DE | 43 04 015 | 8/1994 |
| DE | 43 04 062 | 8/1994 |
| DE | 44 43 644 | 6/1996 |
| EP | 304 192 | 2/1989 |
| EP | 164 514 | 6/1989 |
| EP | 345090 | 12/1989 |
| EP | 353 976 | 2/1990 |
| EP | 367 399 | 5/1990 |
| EP | 384 070 | 8/1990 |
| EP | 390 251 | 10/1990 |
| EP | 420 317 | 4/1991 |
| EP | 555 622 | 8/1993 |
| GB | 707994 | 4/1954 |
| GB | 748780 | 5/1956 |
| GB | 953655 | 3/1964 |
| GB | 1 118 908 | 7/1968 |
| GB | 1 341 557 | 12/1973 |
| GB | 1 437 950 | 6/1976 |
| GB | 1 470 250 | 4/1977 |
| GB | 1 473 201 | 5/1977 |
| GB | 1 473 202 | 5/1977 |
| GB | 2166452 | 5/1986 |
| GB | 2 209 172 | 5/1989 |
| IN | 166 307 | 4/1990 |
| RO | 88903 | 6/1986 |
| WO | 93/04154 | 3/1993 |
| WO | 93/19151 | 9/1993 |
| WO | 93/23520 | 11/1993 |
| WO | 94/03267 | 2/1994 |

(List continued on next page.)

OTHER PUBLICATIONS

Watano et al., "Scale–Up of Agitation Fluidized Bed Granulation I. Preliminary Experimental Approach for Optimization of Process Variables", Chem. Pharm. Bull., vol. 43 (No. 7), Parts I–IV, pp. 1212–1230, 1995.

Schaefer et al., "Control of Fluidized Bed Granulation", Arch. Pharm. Chemi. Sci. Ed. 5, pp. 51–60, 1977.

*Primary Examiner*—Lorna M. Douyon
(74) *Attorney, Agent, or Firm*—Rimma Mitelman

(57) ABSTRACT

A granular detergent product is made by spraying a liquid binder to contact a particulate solid starting material in a low shear granulator such as a fluidized bed apparatus. The $d_{3,2}$ average droplet diameter of the liquid binder is not greater than ten times the $d_{3,2}$ average particle diameter of that fraction of the solid starting material which has a $d_{3,2}$ particle diameter of from 20 $\mu$m to 200 $\mu$m provided that if more than 90% by weight of the solid starting material has a $d_{3,2}$ average particle diameter less than 20 $\mu$m then the $d_{3,2}$ average particle diameter of the total solid starting materials shall be taken to be 20 $\mu$m. If more than 90% by weight of the solid starting material has a $d_{3,2}$ average particle diameter greater than 200 $\mu$m than the $d_{3,2}$ average particle diameter of the total starting solid material shall be taken to be 200 $\mu$m.

6 Claims, No Drawings

U.S. PATENT DOCUMENTS

| | | |
|---|---|---|
| WO | 94/24260 | 10/1994 |
| WO | 95/00630 | 1/1995 |
| WO | 95/25158 | 9/1995 |
| WO | 96/03485 | 2/1996 |
| WO | 96/04359 | 2/1996 |
| WO | 97/22685 | 6/1997 |
| WO | 97/28246 | 8/1997 |
| WO | 98/14549 | 4/1998 |
| WO | 98/14550 | 4/1998 |
| WO | 98/14551 | 4/1998 |
| WO | 98/14552 | 4/1998 |
| WO | 98/14553 | 4/1998 |
| WO | 98/14554 | 4/1998 |
| WO | 98/14555 | 4/1998 |
| WO | 98/14556 | 4/1998 |
| WO | 98/14557 | 4/1998 |
| WO | 98/14558 | 4/1998 |
| WO | 98/58046 | 12/1998 |
| WO | 98/58047 | 12/1998 |
| WO | 98/58048 | 12/1998 |
| WO | 99/00475 | 1/1999 |
| WO | 99/03964 | 1/1999 |
| WO | 99/03966 | 1/1999 |
| WO | 99/03967 | 1/1999 |

* cited by examiner

PRODUCTION OF DETERGENT GRANULATES

This is a continuation of Ser. No. 09/097,335 filed Jun. 15, 1998 now U.S. Pat. No. 6,274,544.

The present invention relates to a process for the production of granular detergent compositions.

It is long known in the art to obtain detergent powders by spray drying. However, the spray-drying process is both capital and energy intensive and consequently the resultant product is expensive.

More recently, there has been much interest in production of granular detergent products by processes which employ mainly mixing, without the use of spray drying. These mixing techniques can offer great flexibility in producing powders of various different compositions from a single plant by post-dosing various components after an initial granulation stage.

A known kind of mixing process, which does not involve spray drying, employs a moderate-speed granulator (a common example often colloquially being called a "ploughshare"), optionally preceded by a high-speed mixer (a common example often colloquially being called a "recycler" due to its recycling cooling system). Typical examples of such processes are described in our European patent specifications EP-A-367 339, EP-A-390 251 and EP-A-420 317. These moderate-speed and high-speed mixers exert relatively high levels of shear on the materials being processed.

Until recently, there has been less effort in developing use of low-shear mixers or granulators. One type of low-shear equipment is a gas fluidisation granulator. In this kind of apparatus, a gas (usually air) is blown through a body of particulate solids onto which is sprayed a liquid component. A gas fluidisation granulator is sometimes called a "fluidised bed" granulator or mixer. However, this is not strictly accurate since such mixers can be operated with a gas flow rate so high that a classical "bubbling" fluid bed does not form.

Although low-shear granulators can give good control of bulk density, there is still a need for greater flexibility and in particular, for producing lower bulk density powders. Processes involving low-shear granulation are quite varied.

Indian Patent No. 166307 (Unilever) describes use of an internal recirculating gas fluidisation granulator and explains that use of a conventional fluidised bed will lead to a lumpy and sticky product.

East German Patent No. 140 987 (VEB Waschmittelwerk) discloses a continuous process for the production of granular washing and cleaning compositions, wherein liquid nonionic surfactants or the acid precursors of anionic surfactants are sprayed onto a fluidised powdered builder material, especially sodium tripolyphosphate (STPP) having a high phase II content to obtain a product with bulk density ranging from 530–580 g/l.

WO96/04359 (Unilever) discloses a process whereby low bulk density powders are prepared by contacting a neutralising agent such as an alkaline detergency builder and a liquid acid precursor of an anionic surfactant in a fluidisation zone to form detergent granules.

We have now found that in systems where a liquid binder is sprayed onto a powdered and/or granular solid in a low shear granulator, the droplet size in the spray relative to the particle size of the solids, determines granule size, bulk density and the yield of the process. Thus, the present invention provides a process for the production of a granular detergent product, the process comprising spraying droplets of a liquid binder to contact a particulate solid starting material in a low-shear granulator, wherein the $d_{3,2}$ average droplet diameter of the liquid binder is not greater than 10 times, preferably not greater than 5 times, more preferably not greater than 2 times and most preferably not greater than the $d_{3,2}$ average particle diameter of that fraction of the total solid starting material which has a $d_{3,2}$ particle diameter of from 20 $\mu$m to 200 $\mu$m, provided that if more than 90% by weight of the solid starting material has a $d_{3,2}$ average particle diameter less than 20 $\mu$m then the $d_{3,2}$ average particle diameter of the total solid starting material shall be taken to be 20 $\mu$m and if more than 90% by weight of the solid starting material has a $d_{3,2}$ average particle diameter greater than 200 $\mu$m then the $d_{3,2}$ average particle diameter of the total solid starting material shall be taken to be 200 $\mu$m.

In the context of the present invention, the term "granular detergent product" encompasses granular finished products for sale, as well as granular components or adjuncts for forming finished products, e.g. by post-dosing to or with, or any other form of admixture with further components or adjuncts. Thus a granular detergent product as herein defined may, or may not contain detergent material such as synthetic surfactant and/or soap. The minimum requirement is that it should contain at least one material of a general kind of conventional component of granular detergent products, such as a surfactant (including soap), a builder, a bleach or bleach-system component, an enzyme, an enzyme stabiliser or a component of an enzyme stabilising system, a soil anti-redeposition agent, a fluorescer or optical brightener, an anti-corrosion agent, an anti-foam material, a perfume or a colourant.

As used herein, the term "powder" refers to materials substantially consisting of grains of individual materials and mixtures of such grains. The term "granule" refers to a small particle of agglomerated powder materials. The final product of the process according to the present invention consists of, or comprises a high percentage of granules. However, additional granular and or powder materials may optionally be post-dosed to such a product.

The solid starting materials of the present invention are particulate and may be powdered and/or granular.

All references herein to the $d_{3,2}$ average of solid starting materials refers to the $d_{3,2}$ average diameter only of solids immediately before they are added to the low-shear granulation process per se. For example, hereinbelow it is described how the low-shear granulator may be fed by at least partially pre-granulated solids from a premixer. It is very important to note that "solid starting material" is to be construed to comprise all of the material from the premixer which is fed to the low-shear granulation process but does not include all solids as dosed to the premixer and/or direct to any other processing stage up to processing or after the end of processing in the low-shear granulator. For example, a layering agent or flow aid added after the granulation process in the low-shear granulator does not constitute a solid starting material.

The process of the present invention may be carried out in either batch or continuous mode of operation as desired.

Whether the low-shear granulation process of the present invention is a batch process or a continuous process, solid starting material may be introduced at any time during the time when liquid binder is being sprayed. In the simplest form of process, solid starting material is first introduced to the low-shear granulator and then sprayed with the liquid binder. However, some solid starting material could be introduced at the beginning of processing in the low-shear granulator and the remainder introduced at one or more later times, either as one or more discrete batches or in continuous fashion. However, all such solids fall within the definition of "solid starting material".

The $d_{3,2}$ diameter of the solid starting materials is that obtained by, for example, a conventional laser diffraction technique (e.g. using a Helos Sympatec instrument) or sieving as would be well-known to the skilled person.

Suitably, the solid starting material(s) have a particle size distribution such that not more than 5% by weight of the particles have a particle size greater than 250 μm. It is also preferred that at least 30% by weight of the particles have a particle size below 100 μm, more preferably below 75 μm. However the present invention is also usable with larger fractions of solid starting materials (i.e. >5% more than 250 μm, optionally also <30% below 100 μm or 75 μm) but this increases the chance of some crystals of unagglommerated starting materials being found in the final product. This presents a cost benefit in allowing use of cheaper raw materials. In any event, the particulate solid starting material(s) have an average particle size below 500 μm to provide detergent powders having a particularly desired low bulk density. Within the context of solid starting materials, reference to an average particle size means the $d_{3,2}$ average particle diameter.

The maximum $d_{3,2}$ average droplet diameter is preferably 200 μm, for example 150 μm, more preferably 120 μm, still more preferably 100 μm and most preferably 80 μm. On the other hand, the minimum $d_{3,2}$ droplet diameter is 20 μm, more preferably 30 μm and most preferably 40 μm. It should be noted that in specifying any particular preferred range herein, no particular maximum $d_{3,2}$ average droplet diameter is associated with any particular minimum $d_{3,2}$ average droplet diameter. Thus, for example, a preferred range would be constituted by 150–20 μm, 150–30 μm, 150–40 μm, 120–20 μm, 120–30 μm . . . and so on.

The $d_{3,2}$ average droplet diameter is suitably measured, for example, using a laser phase doppler anemometer or a laser light-scattering instrument (e.g. as supplied by Malvern or Sympatec) as would be well-know to the skilled person.

The present invention is not specific to use of any particular kind of low-shear granulator but if one of the gas fluidisation kind is selected, then the liquid binder can be sprayed from above and/or below and/or within the midst of the fluidised solids.

The invention also encompasses a granular detergent composition obtainable by a process according to the present invention.

The present invention not only provides control of particle size and bulk density in the final product, it also avoids production of irregular-shaped particles. Moreover, it enables the process to be controlled in a way which ensures that fluidisation continues unhindered, especially (although not exclusively) when the low-shear granulator is of the gas fluidisation kind.

Preferably, but not exclusively, in the process according to the present invention, the low-shear granulator is of the gas fluidisation type and comprises a fluidisation zone in which the liquid binder is sprayed onto the solid material. However, a rotating drum or bowl mixer/granulator could also be used.

The low-shear granulator (of whatever kind) may be adapted to recycle "fines" i.e. powdered or part-granular material of very small particle size, so that they are returned to the input or any other stage of operation of the low-shear granulator and/or of any pre-mixer. The fines recycled in this way, especially but not exclusively for a low-shear granulator operating in continuous mode, may be recycled for use as a flow aid and/or layering agent as described further hereinbelow. A further aspect of the invention may provide a process of forming a granular detergent product, the process comprising, in a low-shear granulator, contacting a fluidised solid starting material with a spray of liquid binder, extracting fine particulates during granulation and re-introducing the fine particulates to the process to act as a flow aid or layering agent. Preferably the fine particulates are elutriated material, e.g. they are present in the air leaving a gas fluidisation chamber.

Moreover, when the low-shear granulator is of the gas fluidisation kind it may sometimes be preferable to use equipment of the kind provided with a vibrating bed.

In a preferred class of processes according to the present invention, the liquid binder comprises an acid precursor of an anionic surfactant and the solid starting material comprises an inorganic alkaline material.

Such an acid precursor may for example be the acid precursor of a linear alkylbenzene sulphonate (LAS) or primary alkyl sulphate (PAS) anionic surfactant or of any other kind of anionic surfactant.

Suitable materials for use as the inorganic alkaline material include alkali metal carbonates and bicarbonates, for example sodium salts thereof.

The neutralising agent is very preferably present at a level sufficient to neutralise fully the acidic component. If desired, a stoichiometric excess of neutralising agent may be employed to ensure complete neutralisation or to provide an alternative function, for example as a detergency builder, e.g. if the neutralising agent comprises sodium carbonate.

The liquid binder may alternatively or additionally contain one or more other liquid materials such as liquid nonionic surfactants and/or organic solvents. The total amount of acid precursor will normally be as high as possible, subject to the presence of any other components in the liquid and subject to other considerations referred to below. Thus, the acid precursor may constitute at least 98% (e.g. at least 95%) by weight of the liquid binder, but could be at least 75%, at least 50% or at least 25% by weight of the binder. It can even, for example, constitute 5% or less by weight of the binder. Of course the acid precursor can be omitted altogether if required.

When liquid nonionic surfactant is present in the liquid binder together with an acid precursor of an anionic surfactant, then the weight ratio of all acid precursor(s) to nonionic surfactants, will normally be from 20:1 to 1:20. However, this ratio may be, for example, 15:1 or less (of the anionic), 10:1 or less, or 5:1 or less. On the other hand, the nonionic may be the major component so that the ratio is 1:5 or more (of the nonionic), 1:10 or more, or 1:15 or more. Ratios in the range from 5:1 to 1:5 are also possible.

For manufacture of granules containing anionic surfactant, sometimes it will be desirable not to incorporate all of such anionic by neutralisation of an acid precursor. Some can optionally be incorporated in the alkali metal salt form, dissolved in the liquid binder or else as part of the solids. In that case, the maximum amount of anionic incorporated in the salt form (expressed as the weight percentage of total anionic surfactant salt in the product output from the low shear granulator) is preferably no more than 70%, more preferably no more than 50% and most preferably no more than 40%.

If it is desired to incorporate a soap in the granules, this can be achieved by incorporating a fatty acid, either in solution in the liquid binder or as part of the solids. The solids in any event must then also comprise an inorganic alkaline neutralising agent to react with the fatty acid to produce the soap.

The liquid binder will often be totally or substantially non-aqueous, that is to say, any water present does not exceed 25% by weight of the liquid binder, but preferably no more than 10% by weight. However, if desired, a controlled amount of water may be added to facilitate neutralisation. Typically, the water may be added in amounts of 0.5 to 2% by weight of the final detergent product. Any such water is suitably added prior to or together or alternating with the addition of the acid precursor.

Alternatively, an aqueous liquid binder may be employed. This is especially suited to manufacture of products which are adjuncts for subsequent admixture with other components to form a fully formulated detergent product. Such adjuncts will usually, apart from components resulting from the liquid binder, mainly consist of one, or a small number of components normally found in detergent compositions, e.g. a surfactant or a builder such as zeolite or sodium tripolyphosphate. However, this does not preclude use of aqueous liquid binders for granulation if substantially fully formulated products. In any event, typical aqueous liquid binders include aqueous solutions of alkali metal silicates, water soluble acrylic/maleic polymers (e.g. Sokalan CP5) and the like.

In a refinement of the process of the present invention, the solid starting material may be contacted and mixed with a first portion of the liquid binder, e.g. in a low, moderate or high-shear mixer (i.e. a pre-mixer) to form a partially granulated material. The latter can then be sprayed with a second portion of the liquid binder in the low-shear granulator, to form the granulated detergent product.

In such a two-stage granulation process, it is preferred, but not absolutely necessary, for the total of liquid binder to be dosed only in the partial granulation pre-mixer and low-shear granulation steps. Conceivably, some could be dosed before the partial granulation pre-mixing and/or other earlier processing steps. Also, the content of the liquid binder could be varied between the first and second stages. The extent of granulation in the pre-mixer (i.e. partial granulation) and the amount of granulation in the low-shear granulator is preferably determined in accordance with the final product density desired. Preferred amounts of liquid binder to be dosed at each of the two stages may be varied thus:

(i) If a lower powder density is desired, i.e., 350–650 g/l
  (a) 5–75% by weight of total liquid binder is preferably added in the pre-mixer; and
  (b) the remaining 95–25% by weight of total liquid binder is preferably added in the low-shear granulator.

(ii) If a higher powder density is desired, i.e. 550–1300 g/l
  (a) 75–95% by weight of total liquid binder is preferably added in the pre-mixer; and
  (b) the remaining 25–5% by weight of total liquid binder is preferably added in the low-shear granulator.

If an initial pre-mixer is used for partial granulation, an appropriate mixer for this step is a high-shear Lodige$^R$ CB machine or a moderate-speed mixer such as a Lodige$^R$ KM machine. Other suitable equipment includes Drais$^R$ T160 series manufactured by Drais Werke GmbH, Germany; the Littleford mixer with internal chopping blades and turbine-type miller mixer having several blades on an axis of rotation. A low- or high-shear mixer granulator has a stirring action and/or a cutting action which are operated independently of one another. Preferred types of low- or high-shear mixer granulators are mixers of the Fukae$^R$ FS-G series; Diosna$^R$ V series ex Dierks & Sohne, Germany; Pharma Matrix$^R$ ex T.K. Fielder Ltd; England. Other mixers believed to be suitable for use in the process of the invention are Fuji$^R$ VG-C series ex Fuji Sangyo Co., Japan; the Roto$^R$ ex Zanchetta & Co. srl, Italy and Schugi$^R$ Flexomix granulator.

Yet another mixer suitable for use in a pre-granulation stage is the Lodige (Trade Mark) FM series (ploughshare mixers) batch mixer ex Morton Machine Co. Ltd., Scotland.

If a gas fluidisation granulator is used as the low-shear granulator, then preferably it is operated at a superficial air velocity of about 0.1–1.2 $ms^{-1}$, either under positive or negative relative pressure and with an air inlet temperature ranging from −10° or 5° C. up to 80° C., or in some cases, up to 200° C. An operational temperature inside the bed of from ambient temperature to 60° C. is typical. Preferably, the superficial air velocity is at least 0.45 and more preferably at least 0.5 $ms^{-1}$. Preferably, the superficial air velocity is in the range 0.8–1.2 $ms^{-1}$.

Optionally, a "layering agent" or "flow aid" may be introduced at any appropriate stage. This is to improve the granularity of the product, e.g. by preventing aggregation and/or caking of the granules. Any layering agent/flow aid is suitably present in an amount of 0.1 to 15% by weight of the granular product and more preferably in an amount of 0.5 to 5%.

Suitable layering agents/flow aids (whether or not introduced by recirculation) include crystalline or amorphous alkali metal silicates, aluminosilicates including zeolites, Dicamol, calcite, diatomaceous earths, silica, for example precipitated silica, chlorides such as sodium chloride, sulphates such as magnesium sulphate, carbonates such as calcium carbonate and phosphates such as sodium tripolyphospate. Mixtures of these materials may be employed as desired.

In general, additional components may be included in the liquid binder or admixed with the solid neutralising agent at an appropriate stage of the process. However, solid components can be post-dosed to the granular detergent product.

In addition to any anionic surfactant which optionally may be produced by a neutralisation step, further anionic surfactants, or nonionic surfactant as mentioned above, also, cationic, zwitterionic, amphoteric or semipolar surfactants and mixtures thereof may be added at a suitable time. In general suitable surfactants include those generally described in "Surface active Agents and Detergents" Vol I by Schwartz and Perry. As mentioned above if desired, soap derived from saturated or unsaturated fatty acids having, for example having an average of $C_{10}$ to $C_{18}$ carbon atoms may also be present.

If present, the detergent active is suitably incorporated at a level of 5 to 40%, preferably 10 to 30% by weight of the final granular detergent product.

A complete detergent composition often contains a detergency builder. Such a builder may be introduced with the solid material and/or added subsequently as desired. The builder may also constitute a neutralising agent, for example sodium carbonate, in which case sufficient material will be employed for both functions.

Generally speaking, the total amount of detergency builder in the granular product is suitably from 5 to 95%, for example from 10 to 80%, more preferably from 15 to 65%, especially from 15 to 50% by weight.

Inorganic builders that may be present include sodium carbonate, if desired in combination with a crystallisation seed for calcium carbonate as disclosed in GB-A-1 437 950. Any sodium carbonate will need to be in excess of any used to neutralise the anionic acid precursor if the latter is added during the process.

Other suitable builders include crystalline and amorphous aluminosilicates, for example zeolites as disclosed in GB-A-1 473 201; amorphous aluminosilicates as disclosed in GB-A-1 473 202; and mixed crystalline/amorphous aluminosilicates as disclosed in GB 1 470 250; and layered silicates as disclosed in EP-B-164 514. Inorganic phosphate builders, for example, sodium orthophosphate, pyrophosphate and tripolyphosphate, may also be present, but on environmental grounds those are no longer preferred.

Aluminosilicates, whether used as layering agents and/or incorporated in the bulk of the particles may suitably be present in a total amount of from 10 to 60% and preferably an amount of from 15 to 50% by weight. The zeolite used in most commercial particulate detergent compositions is zeolite A. Advantageously, however, maximum aluminium zeolite P (zeolite MAP) described and claimed in EP-A-384 070 may be used. Zeolite MAP is an alkali metal aluminosilicated of the P type having a silicon to aluminium ratio not exceeding 1.33, preferably not exceeding 1.15, and more preferably not exceeding 1.07.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. A copolymer of maleic acid, acrylic acid and vinyl acetate is especially preferred as it is biodegradable and thus environmentally desirable. This list is not intended to be exhaustive.

Especially preferred organic builders are citrates, suitably used in amounts of from 5 to 30%, preferably from 10 to 25% by weight; and acrylic polymers, more especially acrylic/maleic copolymers, suitably used in amounts of from 0.5 to 15%, preferably from 1 to 10% by weight. Citrates can also be used at lower levels (eg 0.1 to 5% by weight) for other purposes. The builder is preferably present in alkali metal salt, especially sodium salt, form.

Suitably, the builder system may also comprise a crystalline layered silicate, for example, SKS-6 ex Hoechst, a zeolite, for example, zeolite A and optionally an alkali metal citrate.

The granular composition resulting from the process of the present invention may also comprise a particulate filler (or any other component which does not contribute to the wash process) which suitably comprises an inorganic salt, for example sodium sulphate and sodium chloride. The filler may be present at a level of 5 to 70% by weight of the granular product.

The present invention also encompasses a granular detergent product resulting from the process of the invention (before any post-dosing or the like). This product will have a bulk density determined by the exact nature of the process. If the process does not involve a pre-mixer to effect partial granulation, a final bulk density of 350–750 g/l can normally be expected. As mentioned above, use of a pre-mixer enables the final bulk density to be 350–650 g/l or 550–1300 g/l, respectively, according to whether option (i) or (ii) is utilised. However, granular detergent products resulting from the present invention are also characterised by their particle size ranges. Preferably not more than 10% by weight has a diameter >1.4 mm and more preferably, not more than 5% by weight of the granules are above this limit. It is also preferred that not more than 20% by weight of the granules have a diameter >1 mm. Finally, the granules can be distinguished from granules produced by other methods by mercury porosimetry. The latter technique cannot reliably determine the porosity of individual unagglomerated particles but is ideal for characterising the granules.

A fully formulated detergent composition produced according to the invention might for example comprise the detergent active and builder and optionally one or more of a flow aid, a filler and other minor ingredients such as colour, perfume, fluorescer, bleaches, enzymes.

The invention will now be illustrated by the following non-limiting examples:

EXAMPLES

Example 1

In examples I to V, the following formulation was produced using a Spraying Systems nozzle SU 22, operating at 2.5 or 5 bar atomising air pressure:

| | |
|---|---|
| Sodium-LAS | 24 wt % |
| Sodium-Carbonate | 32 wt % |
| STPP | 32 wt % |
| Zeolite 4A | 10 wt % |
| Water | 2 wt % |

In example VI, the following formulation was produced using a Spraying Systems SUE 25 nozzle, operating at 3.5 bar atomising air presssure:

| | |
|---|---|
| STP (Rhodiaphos H5) | 63 wt % |
| Sokolan CP5 | 9 wt % |
| Water | 28 wt % |

In examples I to V, the rate of addition of the liquid (i.e. LAS) to the fluidising solids was varied from 130 to 590 $gmin^{-1}$. In example VI, the rate of addition of the liquid (i.e. a 20% CP5 aqueous solution) to the fluidising STP powder was 400 $gmin^{-1}$.

In examples I to VI, the $d_{3,2}$ average particle size of those solids from 20 $\mu$m to 200 $\mu$m was, in all cases, 69 $\mu$m.

Table 1 records the influences on the powders produced:

TABLE 1

| Example | | I | II | III | IV | V | VI |
|---|---|---|---|---|---|---|---|
| Nozzle | | SU22 | SU22 | SU22 | SU22 | SU22 | SUE25 |
| LAS addition rate | [$gmin^{-1}$] | 130 | 400 | 590 | 130 | 400 | |
| CP5 (20% soln) addition rate | [$gmin^{-1}$] | | | | | | 400 |
| Atomisation pressure | [bar] | 2.5 | 2.5 | 2.5 | 5 | 5 | 3.5 |
| Droplet size* | [$\mu$m] | 45.1 | 57.4 | 61.6 | 38.8 | 45.3 | 65 |
| Bulk density | [g/l] | 457 | 528 | 596 | 471 | 475 | 530 |
| Coarse fraction >1400 $\mu$m | [wt %] | 3.6 | 8.4 | 20.6 | 0.1 | 0.4 | 0.54 |
| RRd** | [$\mu$m] | 460 | 640 | 689 | 338 | 486 | 515 |

*$d_{3,2}$ average diameter

**The n value of the Rosin Rammler distribution is calculated by fitting the particle size distribution to an n-power distribution according to the following formula: →

$$R = 100 * \mathrm{Exp}\left\{-\left(\frac{D}{D_r}\right)^n\right\}$$

where R is the cumulative percentage of powder above a certain size D. $D_r$ is the average granule size (corresponding to RRd) and n is a measure of the particle size distribution. $D_r$ and n are the Rosin Rammler fits to a measured particle size distribution. A high n value means narrow particle size distribution and low values mean a broad particle size distribution.

Example 2

The droplet size was measured using a laser light scattering technique. LAS acid, at 55° C., was delivered through the nozzle at a rate of 90 $kgh^{-1}$. At a distance of 32 cm from the nozzle tip, the $d_{3,2}$ droplet size was measured in the centre of the well-formed spray pattern. For atomising air pressures of 1, 2 and 3.5 bar, the $d_{3,2}$ droplet size was measured as 51.4, 47.0 and 29.9 $\mu$m, respectively.

What is claimed is:

1. A process for the production of a granular detergent product, the process comprising spraying droplets of a liquid binder to contact a particulate solid starting material in a low-shear granulator, wherein:

the liquid binder is substantially non-aqueous, containing not more than 25% water;

the liquid binder comprises an acid precursor of an anionic surfactant and a nonionic surfactant in a weight ratio of the acid precursor to nonionic surfactant from 20:1 to 10:1;

the maximum $d_{3,2}$ average droplet diameter of the liquid binder is 200 $\mu$m, and the minimum $d_{3,2}$ average droplet diameter is 20 $\mu$m, the $d_{3,2}$ average droplet diameter of the liquid binder is not greater than 10 times the $d_{3,2}$ average particle diameter of that fraction of the total solid starting material which has a $d_{3,2}$ particle diameter of from 20 $\mu$m to 200 $\mu$m, provided that if more than 90% by weight of the solid starting material has a $d_{3,2}$ average particle diameter less than 20 $\mu$m then the $d_{3,2}$ average particle diameter of the total solid starting material shall be taken to be 20 $\mu$m and if more than 90% by weight of the solid starting material has a $d_{3,2}$ average particle diameter greater than 200 $\mu$m then the $d_{3,2}$ average particle diameter of the total solid starting material shall be taken to be 200 $\mu$m, the process resulting in the granular detergent having not more than 10% by weight of granules with a diameter above 1.4 mm.

2. A process according to claim 1, wherein the maximum $d_{3,2}$ average droplet diameter is 150 $\mu$m.

3. A process according to claim 1, wherein the granulator is a gas fluidization apparatus.

4. A process according to claim 1, wherein the solid starting material comprises an inorganic alkaline material.

5. A process according to claim 1 further comprising extracting fine particulates during granulation and re-introducing the fine particulates to the low-shear granulator to act as a flow aid or layering agent.

6. A process for the production of a granular detergent product, the process comprising spraying droplets of a liquid binder to contact a particulate solid starting material in a low-shear granulator, wherein:

the liquid binder consists of an acid precursor of an anionic surfactant;

the maximum $d_{3,2}$ average droplet diameter of the liquid binder is 200 $\mu$m, and the minimum $d_{3,2}$ average droplet diameter is 20 $\mu$m, the $d_{3,2}$ average droplet diameter of the liquid binder is not greater than 10 times the $d_{3,2}$ average particle diameter of that fraction of the total solid starting material which has a $d_{3,2}$ particle diameter of from 20 $\mu$m to 200 $\mu$m, provided that if more than 90% by weight of the solid starting material has a $d_{3,2}$ average particle diameter less than 20 $\mu$m then the $d_{3,2}$ average particle diameter of the total solid starting material shall be taken to be 20 $\mu$m and if more than 90% by weight of the solid starting material has a $d_{3,2}$ average particle diameter greater than 200 $\mu$m then the $d_{3,2}$ average particle diameter of the total solid starting material shall be taken to be 200 $\mu$m, the process resulting in the granular detergent having not more than 10% by weight of granules with a diameter above 1.4 mm.

* * * * *